United States Patent [19]

Larwin et al.

[11] Patent Number: 4,963,071

[45] Date of Patent: Oct. 16, 1990

[54] COUPLER ASSEMBLY BETWEEN A PRIME MOVER AND A WORK IMPLEMENT

[75] Inventors: Renee M. Z. Larwin; Richard D. Keen, Jr., both of Kent; Joseph R. Zeno, Cuyahoga Falls, all of Ohio

[73] Assignee: American Coupler Systems, Inc., Kent, Ohio

[21] Appl. No.: 370,703

[22] Filed: Jun. 23, 1989

[51] Int. Cl.[5] ..... E02F 3/28

[52] U.S. Cl. ..... 414/723; 37/118 R; 172/272

[58] Field of Search ..... 414/723; 37/118 R; 172/272–275

[56] References Cited

U.S. PATENT DOCUMENTS

| | | | |
|---|---|---|---|
| 3,417,886 | 12/1968 | Stuart | 414/723 |
| 3,760,883 | 9/1973 | Birk | 414/723 X |
| 4,253,793 | 3/1981 | Braml | 414/723 |
| 4,477,987 | 10/1984 | Stecklein | 37/118 R |
| 4,824,319 | 4/1989 | Arnold | 414/723 |

*Primary Examiner*—Robert J. Spar
*Assistant Examiner*—Donald W. Underwood
*Attorney, Agent, or Firm*—Renner, Kenner, Greive, Bobak, Taylor & Weber

[57] ABSTRACT

A coupling assembly (10) for demountably attaching a work implement (15) to a prime mover (13). The prime mover (13) has a lifting mechanism (18, 118) and a tilting mechanism (23, 123). The coupling assembly (10) includes a master coupling element (11, 111) adapted to be mounted on the lifting and tilting mechanisms (19 and 20) of the prime mover (13) and an implement coupling element (12, 112) adapted to be atached to the work implement (15). The master coupling element (11, 111) has a frame (25, 125) with upper and lower transverse beam members (26 and 31 or 126 and 131). An aligning horn (28, 128) extends upwardly from the frame (25, 125) of the master coupling element (11, 111). A first, forwardly directed bearing surface (60, 160) extends along the upper transverse beam member (26, 126), and a second, forwardly directed bearing surface (61, 161) extends along said lower transverse beam member (31, 131). The implement coupling element (12, 112) has upper and lower, transversely oriented support members (79 and 82 or 179 and 182). A receiver (29, 129) is presented from the upper support member (79, 179) to be operatively engaged by the aligning horn (28, 128). A first, rearwardly directed bearing surface (81, 181) extends along the upper support member (79, 179), and a second, rearwardly directed bearing surface (83, 183) extends along the lower support member (82, 182). A locking mechanism (30, 130) releasably secures the implement coupling element (12, 112) to the master coupling element (11, 111). The first and second bearing surfaces (60 and 61 or 160 and 161) on the master coupling element (11, 111) are engaged by the first and second bearing surfaces (81 and 83 or 181 and 183), respectively, on the implement coupling element (12, 112) when the aligning horn (28, 128) is operatively engaged within the receiver (29, 129) and the locking mechanism (30, 130) has secured the implement coupling element (12, 112) to the master coupling element (11, 111).

14 Claims, 4 Drawing Sheets

FIG. 8
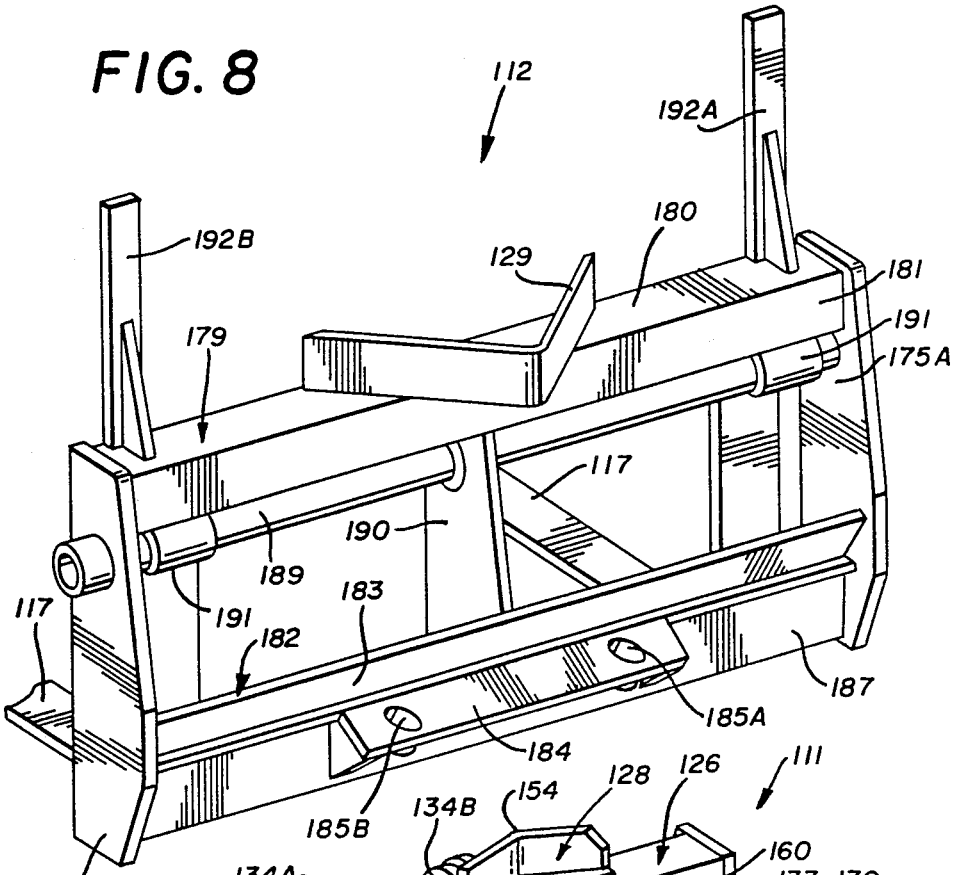
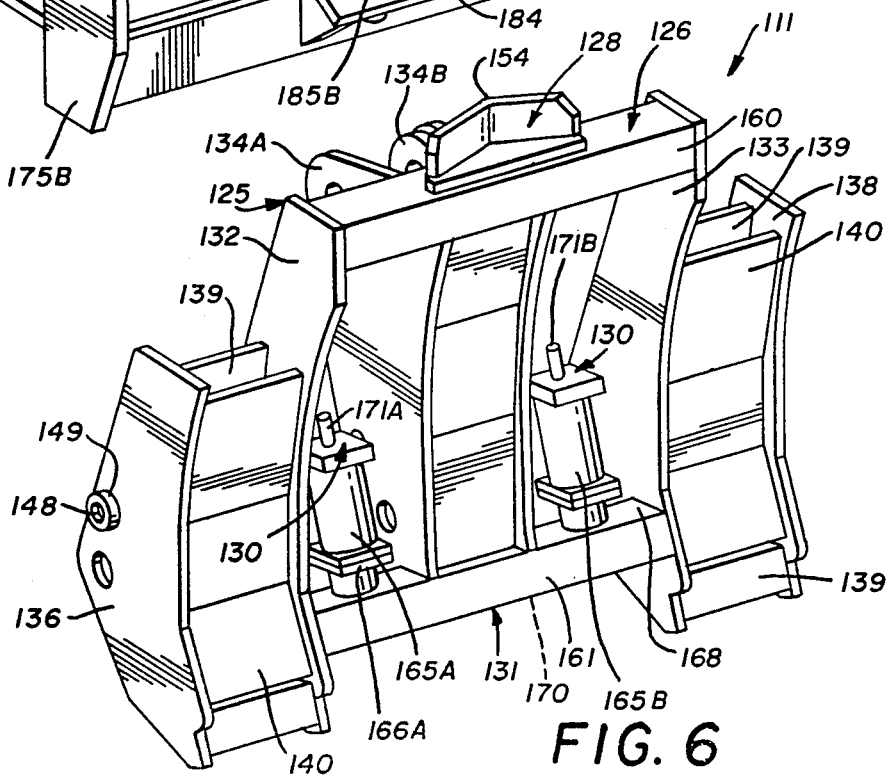
FIG. 6

COUPLER ASSEMBLY BETWEEN A PRIME MOVER AND A WORK IMPLEMENT

TECHNICAL FIELD

The present invention relates generally to connecting structures. More particularly, the present invention relates to structures by which demountably to secure a work implement to a prime mover. Specifically, the present invention relates to a self-aligning coupler assembly by which quickly and efficiently to mount and demount a word implement to a tractor or other prime mover.

BACKGROUND OF THE INVENTION

For many reasons, not the least of which is the relatively high cost for prime movers, it is desirable to be able to employ a single prime mover in conjunction with a plurality of work implements. Historically, the lifting and tilting mechanisms provided by prime movers connected directly to the individual work implements. To change work implements was, at best, a difficult and time consuming chore that would require two workmen. One of the workmen manipulated the prime mover, as well as the lifting and tilting mechanisms presented therefrom. The second workman manually manipulated the work implement in order to assist in effecting the connections between the lifting and tilting mechanisms and the work implement and also served as a "spotter" to observe those areas which would be blocked from the view of the workman manipulating the prime mover by the mechanism presented from the prime mover to effect the connection with the work implement. As a spotter, the second workman thus guided the workman driving the prime mover. Accordingly, it was potentially dangerous to life, limb and property every time work implements had to be changed when utilizing the historic arrangements to effect such a change.

The normal difficulties attendant upon securing a work implement directly to the lifting and tilting mechanisms presented from the prime mover forced efficient operators to minimize the number of times the work implements are changed and to provide a relatively level area upon which to store the work implements inasmuch as the most efficient performance of the inefficient task of manually changing work implements could only occur if both the work implement and the prime mover were on level terrain.

The many disadvantages of demountably attaching work implements manually, and directly, to the lifting and tilting mechanisms on a prime mover were obviated by the system disclosed in U.S. Pat. No. 3,417,886, and as a result that system has received wide acceptance over the years.

One of the principal disadvantages of the system to which U.S. Pat. No. 3,417,886 is directed does not involve the system itself. Rather, the disadvantage results from the purchasing procedure imposed upon users of more than one prime mover and the various work implements demountably attachable thereto. Such users do not normally acquire all their prime movers at the same time. Generally, a user having more than one prime mover will have acquired them over the years, and such sporadic purchases are frequently made on the basis of the lowest cost. Hence, such entities often own prime movers which originate from more than one manufacturer as well as work implements which also originate from a number of different manufactures.

Modest dimensional differences between the attachment points for the lifting and tilting mechanisms on prime movers originating from different manufacturers require a separte coupling member for attachment to the prime mover from each different manufacturer, as well as for each different size and model of prime mover from even one manufacturer. Each different coupling member attached to the prime movers similarly requires that a separate and distinct coupling member be attached to the work implements to be employed by each prime mover. Hence, while the concept for utilizing coupling systems incorporating the concepts of U.S. Pat. No. 3,417,886 did definitely have its advantages, the realities of dimensional differences between equipment acquired from different manufacturers precluded total acceptance of that system.

The foregoing difficulties have been further compounded by the recent trend for prime mover manufactures to make both four-arm lifting and tilting mechanisms and three-arm lifting and tilting mechanisms available as alternative options. This further compounds the number of coupling elements required to be made available not only for attachment to various prime movers but also for attachement to several work implements.

The difficulties are more readily appreciated when one recognizes the fact that the coupler element utilized by each work implement is normally affixed relatively permanently to that work implement.

The prior known coupling assemblies also utilize the locking mechanism, and perhaps some modest vertical contact between the coupling elements, to assist in the transfer of both static and dynamic loading between the coupling elements. Arrangements of that nature impart highly concentrated loading stresses to the structure of the coupling elements, which can be deleterious to the coupling assembly.

Finally, most known attempts to obviate the foregoing adverse characteristics of prior known coupler assemblies result in locating the center of gravity of the work implement more forwardly of the prime mover than desirable.

SUMMARY OF THE INVENTION

It is, therefore, a primary object of the present invention to provide an improved coupler assembly which employs a single point, self aligning, pick up arrangement between the master coupling element attached to a prime mover and an implement coupling element attached to a work implement.

It is another object of the present invention to provide an improved coupler assembly, as above, in which the weight, and force, transfer between the implement coupling element and master coupling element—i.e., the static and dynamic loading occasioned when the prime mover is moving in such a direction that it is being preceded by the work implement—is effected between bearing surfaces that extend transversely rather than vertically.

It is a further object of the present invention to provide an improved coupler assembly, as above, wherein the locking mechanism which releasably secures the implement coupling element to the master coupling element is not subjected to dynamic shock loading stresses during the application of loading forces occasioned when the implement and master coupling elements are forcibly abutted.

It is still another object of the present invention to locate the locking mechanism relative to the single point pick up arrangement so as to minimize the application of loads upon the locking machanism when "dumping, " "back-dragging" or otherwise utilizing the work implement in a manner which tends to separate the implement and master coupling elements.

It is yet another object of the present invention to provide an improved coupler assembly, as above, wherein the master coupling elements has an open center portion through which the operator of the prime mover is provided with virtually unimpaired visual observation forwardly therethrough during that manipulation of the master coupling element necessary to assist in positioning the master coupling element relative to the implement coupling element and also in those situations where the work implement itself permits visual observation therethrough.

It is also an object of the present invention to provide the aforesaid, virtually unimpaired visibility to serve as a safety feature which efficiently minimizes the potential for injury to life, limb and property by virtue of the fact that a spotter is not required.

It is a still further object of the present invention to provide an improved coupler assembly, as above, wherein the master coupling elements is as readily adapted for connection to a three-arm lilting and tilting mechanism as a four-arm lifting and tilting mechanism.

It is an even further object of the present invention to provide an improved coupler assembly, as above, which permits the center of gravity for the work implement connected thereby to be located as far rearwardly as reasonably possible.

Finally, it is an additional object of the present invention to provide an improved coupler assembly, as above, whereby a master coupling element adapted for use with a given make, model and size of prime mover can operatively attach to its implement coupling element that is secured to virtually any work implement intended of use with that particular prime mover—i.e., a coupler assembly embodying the concepts of the present invention provides a master coupling element that has compatibility with, and may, therefore, be coupled to, implement coupling elements (also embodying the concepts of the present invention) within a given size range.

These and other objects of the invention, as well as the advantages thereof over existing and prior art forms, which will be apparent in view of the following detailed specification, are accomplished by means hereinafter described and claimed.

In general, a coupling assembly embodying the concepts of the present invention is adapted for demountably attaching a work implement to a prime mover. The prime mover has a lifting mechanism and a tilting mechanism. The coupling assembly includes a master coupling element adapted to be mounted on the lifting and tilting mechanisms of the prime mover and an implement coupling element adapted to be attached to the work implement.

The master coupling element has a frame with upper and lower transverse beam members. An aligning horn extends upwardly from the frame of the master coupling element. A first, forwardly directed bearing surface extends along the upper transverse beam member, and a second, forwardly directed bearing surface extends along the lower transverse beam member.

The implement coupling element has upper and lower, transversely oriented, support members. A receiver is presented from the upper support member to be operatively engaged by the aligning horn. A first, rearwardly directed bearing surface extends along the upper support member, and a second, rearwardly directed bearing surface extends along the lower support member.

A locking mechanism releasably secures the implement coupling element to the master coupling element. The first and second bearing surfaces on the master coupling element are engaged by the first and second bearing surfaces, respectively, on the implement coupling element when the aligning horn is operatively engaged within the receiver and the locking mechanism has secured the implement coupling element to the master coupling element.

One exemplary coupling assembly, and a modification to both the master coupling element and the implement coupling element thereof—all variations embodying the concepts of the present invention—are shown by way of example in the accompanying drawings and are described in detail without attempting to show all of the various forms and modifications in which the invention might be embodied; the invention being measured by the appended claims and not by the details of the specification.

BRIEF DESCRIPTION OF THE DRAWINGS

FIG. 6 is frontal, side perspective view of the alternative form of the master coupling element depicted in FIG. 5;

DESCRIPTION OF AN EXAMPLARY EMBODIMENT

Figure 1:
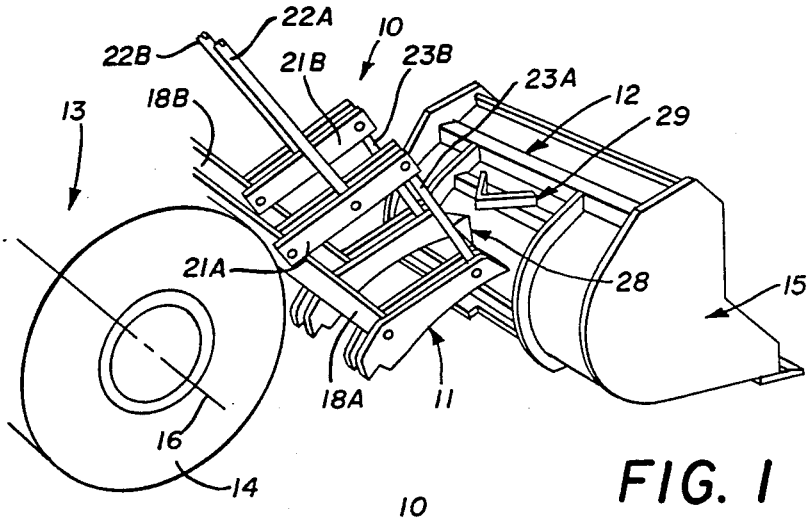
FIG. 1 is a rearwardly, side perspective view schematically depicting a coupler assembly embodying the concepts of the present invention with the master coupling element presented from a prime mover and the implement coupling element secured to a bucket, the master coupling element and the implement coupling element being disengaged.
Figure 2:
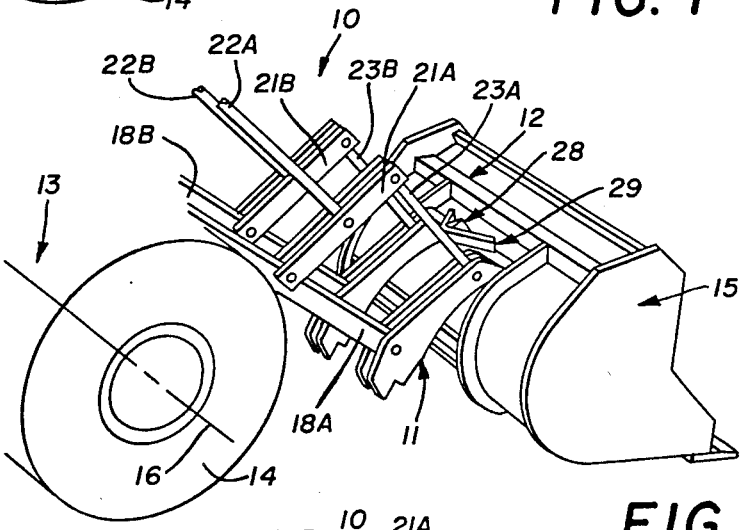
FIG. 2 is a rearwardly, side perspective view similar to FIG. 1 but schematically depicting the master coupling element depicted as having made the require initial contact with the implement coupling element prior to effecting an operative connection between the master coupling element and the receiver on the implement coupling element.
Figure 3:
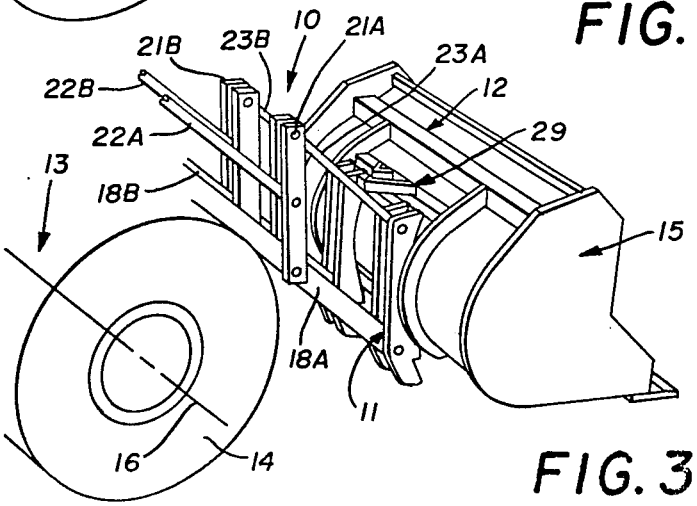
FIG. 3 is a rearwardly side perspective view similar to FIGS. 1 and 2 but schematically depicting the master coupling element operatively connected to the implement coupling element.

One representative form of a coupler assembly embodying the concepts of the present invention is designated generally by the numeral 10 on the accompanying drawings. The representative coupler assembly 10 includes two subassemblies: the master coupling element 11; and, the implement coupling element 12. The master coupling element 11 is operatively presented from a prime mover, such as a tractor 13, the front wheels 14 of which are schematically represented in FIGS. 1–3. The implement coupling element 12 is secured to work implement, such as the bucket 15 also depicted in FIGS. 1–3.

The front wheel 14 of the tractor 13 rotate about axis 16 which, as will hereinafter be more fully explained, constitutes the bearing of the fulcrum about which the load supported from the implement acts in opposition to the weight of the tractor 13. The master coupling element 11 is operatively secured to the tractor 13 by lifting and tilting mechanisms. The lifting mechanism is exemplified by a pair of conventional lifting arms 18 employed by either a conventional four-arm tilting mechanism 19 (explained in conjunction with FIGS. 1–4) or a three-arm tilting mechanism 20 (explained in conjunction with FIG. 5).

In the detailed description which follows, a particular structural member, component or arrangement may be employed at more than one location. When referring generally to that type of structural member, component or arrangement a common numerial designation shall be employed. However, when one of the structural members, components or arrangements so designated is to be individually identified it shall be referenced by virtue of a letter suffix employed in combination with the numerical designation employed for general identification of that structural member, component or arrangement. Thus, there are at least two lifting arms which are generally identified by the numeral 18, but the specific, individual lifting arms are, therefore, identified as 18A and 18B in the specification and on the drawings. This same suffix convention shall be employed throughout the specification.

At the present time both the four-arm lilting and tilting mechanisms 19 and the three-arm lifting and tilting mechanisms 20 are widely employed, each configuration having its staunch devotees. The present invention is readily adaptable for use with either the four-arm lilting and tilting mechanism 19 or the three-arm lifting and tilting mechanism 20, and as such the present invention will be described in conjuction with both arrangements.

The conventional four-arm lifting and tilting mechanism 19 is depicted in conjunction with FIGS. 1–4, and for that reason the description will being with the four-arm lifting and tilting mechanism 19. Specifically, the four-arm lifting and tilting mechanism 19 employs a pair of second class lever arms 21A and 21B, the first end of each of which is pivotally mounted on the respective lifting arms 18A and 18B. A pair of drive arms 22A and 22B, which are controlled by the hydraulic actuators (not shown) of the tractor, are connected to the medial portion of each lever 21A and 21B. A pair of tilt arms 23A and 23B extend outwardly from the second end of the respective lever arms 21A and 21B. The lifting arms 18A and 18B and the tilt arms 23A and 23B are pivotally connected to ther master coupling element 11, as will be hereinafter more fully explained.

Figure 4:
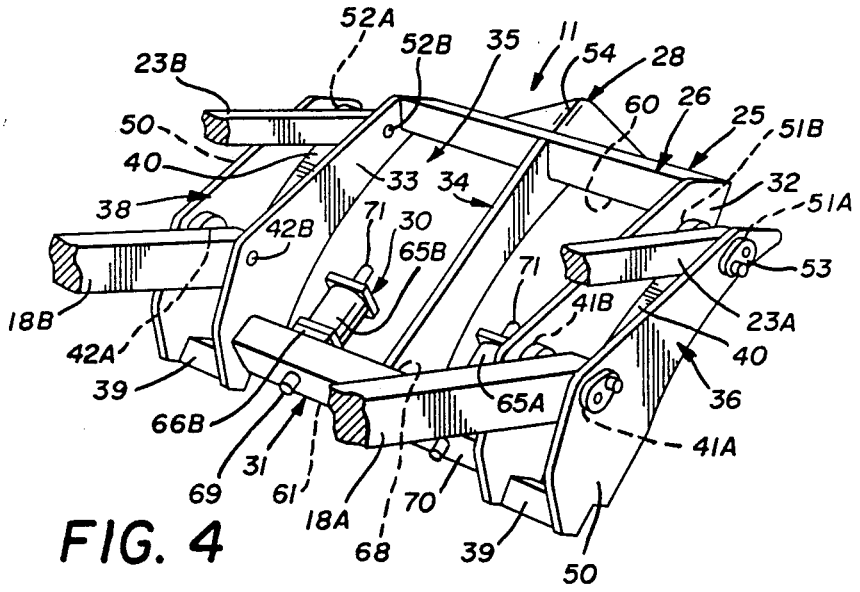
FIG. 4 is an enlarged, rearwardly, side perspective view of the master coupling element represented in FIGS. 1–3 and depicting the structural details of a master coupling element configured for attachment to a four-arm tilting mechanism, the master coupling element being tilted forwardly to reveal those details on the downwardly directed surfaces thereof.

As can best be seen by reference to FIG. 4, the master coupling element 11 has a generally rectangular frame 25, and the transnverse beam member 26 constitutes the horizontally oriented, uppermost structural component of the frame 25. A generally vertically oriented aligning horn 28 is presented, and extends upwardly, from the the upper transverse beam member 26.

The aligning horn 28 is insertable within a receiver 29 presented from the implement coupling element 12 which is secured to the work implement. The implement coupling element 12 is preferably secured, as by welding, to the work implement in the nature of a bucket 15, as will also be hereinafter more fully explained. The implement could be a dozer blade, a scraper blade, a fork lift attachment, a boom or any of the many other work implements that are routinely attached to a tractor for operation thereby.

By way of a brief description as to how the coupler assembly 10 operates, the master coupling element 11 is tilted foward, by the tilt arms 23, and lowered, by manipulation of the lifting arms 18, until the aligning horn 28 is lower than the receiver 29, as depicted in FIG. 1. With the master coupling element 11 and the implement coupling element 12 thus relatively positioned, the operator can manipulate the tractor 13 vertically to align the horn 28 and receiver 29, also as represented in FIG. 1. When the horn 28 is positioned beneath the receiver 29 the operator will lift the master coupling element 11 to insert the aligning horn 28 into the receiver 29, as depicted in FIG. 2. So positioned, the operator will continue to lift the master coupling element 11, by virtue of the lifting arms 18, to raise bucket 15 until its weight is entirely suspended from the aligning horn 28. Therafter, or simultaneously therewith, the operator will tilt the master coupling element 11 counterclockwise as viewed in FIGS. 1–3 by virtue of the tilt arms 23.

As the lifting and tilting mechanism 19 thus lifts and tilts bucket 15, it will pivot and swing, as necessary, about the aligning horn 28 until the bucket 15 is in the position depited in FIG. 3. So positioned, a locking mechanism 30, which will hereinafter be more fully described in conjunction with FIGS. 4–6, releasably secures the implement coupling element 12 to the master c coupling element 11.

With continued reference to FIG. 4, it will be seen that the frame 25 of the master coupling element 11 has not only an upper transverse beam member 26 but also a lower, transverse beam member 31. The transverse beam members 26 and 31 are vertically spaced and are secured to laterally spaced side plates 32 and 33. To add structural rigidity to the frame 25 a vertically disposed reinforcing plate 34 extends between the upper and lower transverse beam members 26 and 31 medially of the side plates 32 and 33. The generally open central portion 35 of the frame 25 permits virtually unimpaired visual observation forwardly through the master coupling element 11 to the operator on the tractor 13 not only during manipulation of the tractor 13 but also during independent manipulation of the master coupling element 11 necessary to position the master coupling element 11 relative to the implement coupling element 12, as described in conjunction with the brief overview of the operation previously set forth herein with respect to FIGS. 1–3.

In order for the master coupling element 11 to have universality in its adaptation for use with tractors 13, or prime movers, supplied by virtually all manufacturers of such equipment, the lateral dimension measured from the outside of the side frame plates 32 and 33 should be no greater than the least lateral dimension between the lifting arms 18 provided by such manufacturers within that size range. In this regard it should be appreciated that the master coupling elements 11 are manufactured for specific sizes, models and manufacturers. But, as will become apparent, such master coupling elements 11, irrespective of the manufacturer for whom made, will be compatible, and thus operatively interconnect, with implement coupling elements 12 within the intended size range, irrespective of which manufacturer supplied the prime mover.

A pair of clevis plates 36 and 38 are spaced laterally outwardly from the side plates 32 and 33, respectively, and are rigidly secured to the respective side plates 32 and 33 by spacer bars 39 and spacer plates 40. The space between each side plate 32 and 33 and the adjacent clevis plate 36 and 38, respectively, is sufficient not only to accommodate the lateral dimension of the ends of the lifting arms 18 received therebetween but also to accommodate the greatest lateral dimension between the lifting arms 18 anticipated to be provided by the various manufacturers of tractors, or prime movers, 13 within a given size range.

Figure 5:
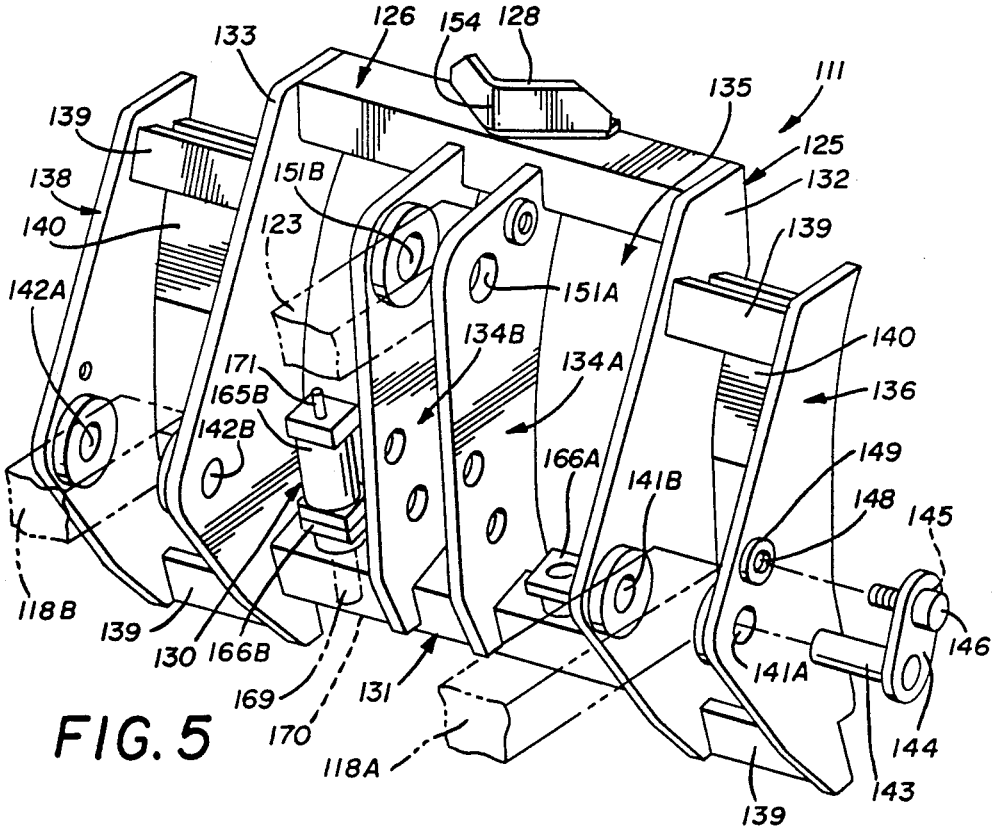
FIG. 5 is a further enlarged, rearwardly, side perspective view of an alternative form of a master coupling element configured for attachement to a three-arm tilting mechanism, the master coupling element being tilted modestly rearwardly to reveal those details on the upwardly directed surfaces thereof.

A first bore 41A penetrates the clevis plate 36 and registers with a first bore 41B which penetrates the adjacent side plate 32. A similar first bore 42A penetrates the clevis plate 38 and the registers with a first bore 42B which penetrates the side plate 33. This arrangement is the same as depicted in the alternative embodiment represented in FIG. 5, and because FIG. 5 is drawn to a larger scale, one may refer to FIG. 5 to see how a connector pin 143 would be receivable through the aligned bores 41A and 41B to secure the end of the lifting arm 18A to the frame 25 of the master coupling element 11, and a similar connector pin (not shown) is receivable through the aligned bores 42A and 42B to secure the outboard end of the lifting arm 18B to the frame 25 of the master coupling element 11. With continued reference to FIG. 5, and as is relatively standard practice, each connector pin 143 has a retaining arm 144 which extends radially outwardly from the outboard end of the pin 143, and the distal end of the retainer arm 144 is provided with a bore 145 through which a safety, cap screw 146 can be received with the threaded aperture 148 in a mounting boss 149 presented from the laterally outwardly directed face identified by the numeral 50 in FIG. 4 of each clevis plates 36 and 38.

A second bore 51A penetrates the clevis plate 36 and registers with a second bore 51B which penetrates the side plate 32. A similar second bore 52A penetrates the clevis plate 38 and registers with a second bore 52B which penetrates the side plate 33. A connector pin 53 is receivable through the aligned second bores 51A and 51B to secure the outboard end of the tilt arm 23A to the frame 25 of the master coupling element 11, and a similar connector pin (not shown) is receivable through the aligned second bores 52A and 52B to secure the board end of the tilt arm 23B to the frame 25 of the master coupling element 11. Each connector pin 53 may have a configuration similar to the connector pins 43 to permit it to be secured in place by means of a safety cap screw 46.

The aligning horn 28 is of generally V-shaped configuration, and, as previously noted, the aligning horn 28 is secured to the upper transverse beam member 26 in the frame 25 of the master coupling element 11. The apex 54 of the V-shaped aligning horn 28 is directed toward the tractor side of the master coupling element 11.

The configuration, and function, of the transverse beam members 26 and 31 in the frame 25 of the master coupling element 11 depicted in FIGS. 1–4 are virtually identical to the corresponding beam members 126 and 131 in the frame 125 of an alternative form of the master coupling element 111 depicted in conjunction with FIGS. 5 and 6. The master coupling element 111 is adapted particularly for use with a three-arm tilting mechanism 20. As such, the alternative form of the master coupling element 111 (depicted in FIG. 5 and 6) will be described before continuing with a description of the transverse beam members 26 and 31 in the frame 25 of the master coupling element 11.

In the three-arm lifting and titling mechanism 20 there are also two, laterally speced lifting arms 118A and 118B, but there is only a single tilt arm 123. As is well known to the art, the single tilt arm 123 may be connected to one end of a first class lever arm (not shown), and the other end of that first class lever arm may be connected to a single drive arm (also not shown) that is controlled by a hydraulic actuator (not shown) of the tractor.

The master coupling element 111 has a generally rectangular frame 125, and the transverse beam member 126 constitutes the horizontally oriented, uppermost structural component of the frame 125. The frame 125 of the master coupling element 111 also has a lower transverse beam member 131 in addition to the upper transverse beam member 126. The transverse beam members 126 and 131 are vertically spaced and are secured to laterally spaced side plates 132 and 133. In lieu of the vertically disposed, single reinforcing plate 34 utilized in the frame 25 of master coupling element 11, the master coupling element 111 utilizes a pair of vertically disposed connector plates 134A and 134B which are laterally spaced and extend between the upper and lower transverse beam members 126 and 131 medially of the side plates 132 and 133. As will hereinafter be more fully described, the single tilting arm 123 of the three-arm lifting and tilting mechanism 20 will be secured between the connector plates 134.

Even the use of the laterally spaced connector plates 134A and 134B does not unduly impair the ability of the operator to see forwardly through the generally open central portion 135 of the frame 125 either during manipulation of the tractor (if the work implement so permits) or during manipulation of the master coupling element 111 necessary to position the master coupling element 111 relative to the implement coupling element 12, as is required to effect the operative coupling therebetween.

A pair of clevis plates 136 and 138 are also spaced laterally outwardly from the side plates 132 and 133, respectively, and rigidly secured to the respective side plates 132 and 133 by spacer bars 139 and spacer plates 14. The space between each side plate 132 and 133 and the adjacent clevis plate 136 or 138, respectively, is sufficient to accommodate the lateral dimension of the ends of the lifting arms 118 received therebetween.

A bore 141A penentrates the clevis plate 136 and registers with a bore 141B which penetrates the side plate 132. A similar bore 142A penetrates the clevis plate 138 and registers with a bore 142B which penetrates the side plate 133. A connector pin 143 is received through the aligned bores 141A and 141B to secure the end of the lifting arm 118A to the frame 125 of the master coupling element 111, and a similar connector pin (not shown) is receivable through the aligned bores 142A and 142B to secure the outboard end of the lifting arm 118B to the frame 125 of the master coupling element 111.

As previously mentioned herein, the single tilt arm 123 of the three-arm lifting and tilting mechanism 20 is to be secured between the connector plates 134. Accordingly, a bore 151A is provided through the upper region of the connector plate 134A, and a bore 151B is provided through connector plate 134B to rigister with the bore 151A. A third connector pin (also not shown) is receivable through the aligned bores 151A and 151B to secure the outboard end of the single tilt arm 123 to the frame 125.

As is relatively standard practice, each connector pin 143 has a retaining arm 144 which extends radially outwardly from the outboard end of the pin 143, and the distal end of the retainer arm 144 is provided with a bore 145 through which a safety, cap screw 146 can be received within the threaded aperture 148 in a mounting boss 149 presented from the respective clevis plates 136 and 138 as well as the connector plate 134A.

The aligning horn 128 is also of generally V-shaped configuration, and, is secured to, and extends upwardly from, the upper transverse beam member 126 in the frame 125 of the master coupling element 111. The apex 154 of the V-shaped aligning horn 128 is directed toward that side of the master coupling element 111 facing the prime mover on which it is mounted.

As is best depicted in FIG. 6, the upper transverse member 126 may well comprise a box beam that presents a relatively flat bearing surface 160 which preferably extends along the full length of the upper transverse beam member 126 on the implement side of the frame 125. Similarly, the lower transverse member 131 may also comprise a box beam which presents a relatively flat bearing surface 161 which preferably extends along the full length of the lower transverse beam member 131.

The locking mechanism 130 utilizes a pair of hydraulic cylinders 165A and 165B which are secured to the respective mounting pedestal 166A and 166B presented from the upwardly directed face 168 of the lower transverse beam member 131. A locking pin 169 is actuated by each cylinder 165 selectively to protract and retract through the generally downwardly directed face 170 of the lower transverse beam member 131.

The upper transverse member 26 of the frame 25 in the master coupling element 11 may similarly comprise a box beam which presents a relatively flat bearing surface 60 which preferably extends along the full length of the upper transverse beam member 26 on the implement side of the frame 25. The lower transverse member 31 may also comprise a box beam which presents a relatively flat bearing surface 61 which preferably extends along the full length of the lower transverse beam member 31.

The locking mechanism 30 utilizes a pair of hydraulic cylinder 65A and 65B which are secured to the respective mounting pedestals 66 presented from the upwardly directed face 68 of the lower transverse beam member 31. A locking pin 69 is actuated by each cylinder 65 selectively to protract and retract through the generally downwardly directed face 70 of the lower transverse beam member 31.

An indicator pin 71 may extend upwardly from each cylinder 65. The indicator pin 71 is operatively connected to, and may well be an oppositely extending extension of, the locking pin 69. In any event, the extent to which the indicator pin 71 extends upwardly from the cylinder 65 will provide a visual indicator to the operator of the prime mover as to whether the pin 69 is extended or retracted.

Figure 7:
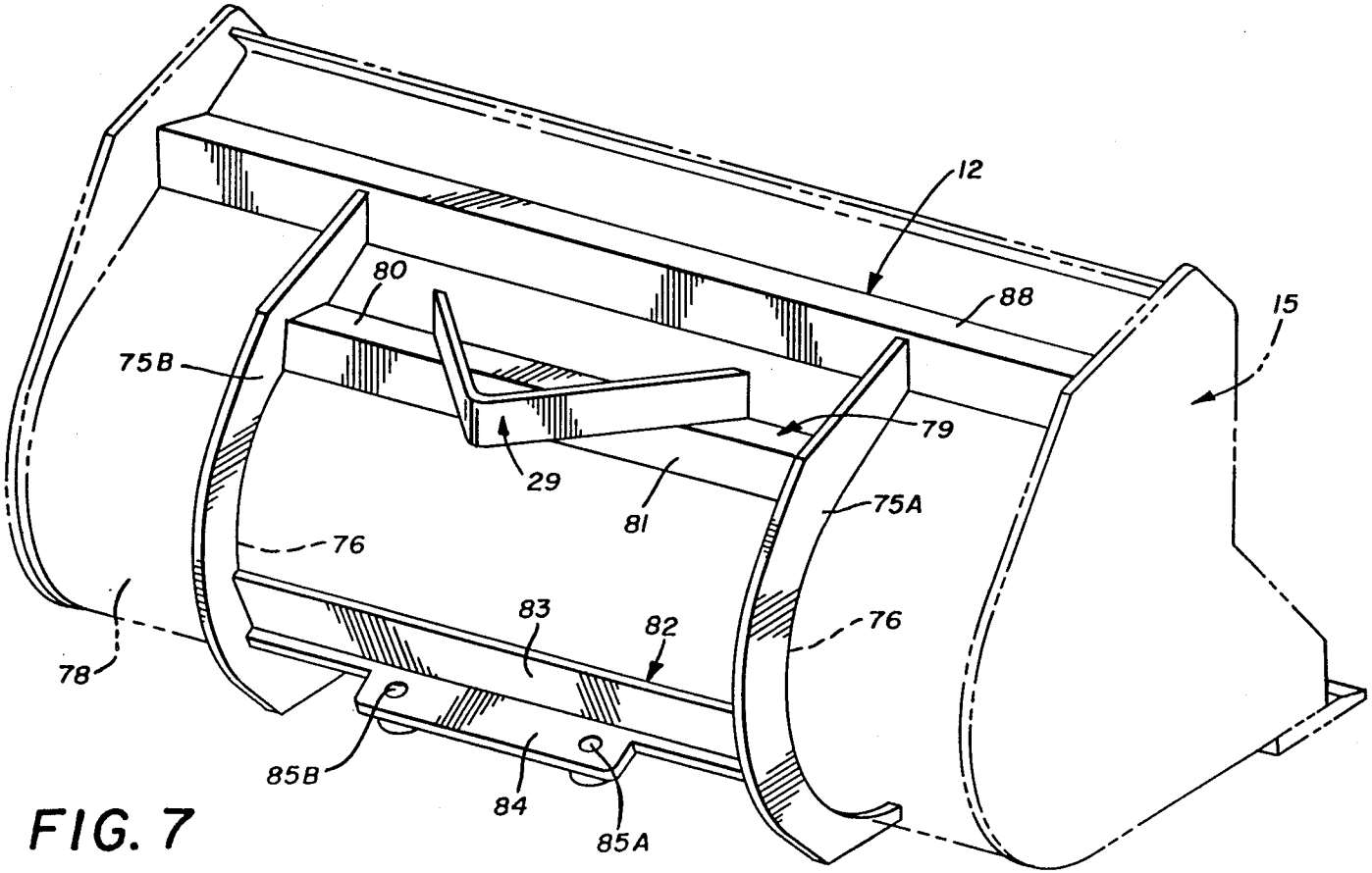
FIG. 7 is a rearwardly side perspective view of the implement coupling element that is adapted for attachment to a work implement having a curvilinear rearwardly directed surface such as the bucket depicted in FIGS. 1–3; and, FIG. 8 is a rearwardly side perspective view of an alternative form of the implement coupling element that is adapted for attachment to a work implement having a planar rearwardly directed surface such as a fork lift attachment, FIG. 8 appearing on the same sheet of drawings as FIG. 6.

Both the master coupling element 11 utilized with a four-arm lifting and tilting mechanism 19 and the master coupling element 111 utilized with a three-arm lifting and tilting mechanism 20 cooperatively interact with the implement coupling element 12 of effect a quick and efficient demountable attachment thereto. With particular reference, then, to FIG. 7, the implement coupling element 12 is depicted as being permanently secured to the bucket 15.

The implement coupling element 12 has a pair of laterally spaced, framing ribs 75A and 75B, the forward edges 76 of which are concavely configured to engage the curvilinear wall 78 of the bucket 15. The laterally spaced framing ribs 75 are preferably secured permanently to the bucket as by being welded to the wall 78 thereof. An upper support member 79 extends transversely between the laterally spaced framing ribs 75, and it too may be permanently secured not only to the laterally spaced framing ribs 75 but also to the wall 78 of the bucket 15. The upper support member 79 presents an upwardly directed mounting surface 80 to which the receiver 29 may be affixed and an outwardly (i.e., rearwardly) directed bearing surface 81 which will lie in contiguous juxtaposition with bearing surface 60 on the upper transverse member 26 of the master coupling element 11 (or the bearing surface 160 on the upper transverse member 126 of the master coupling element 111) when the coupling receiver 12 is operatively mounted on the master coupling element 11 (or the master coupling element 111). As such, the upper support member 79 may comprise a structural angle the two legs of which present the aforesaid mounting surface 80 and the bearing surface 81.

A lower support member 82 is spaced beneath the upper support member 79 to extend transversely between the laterally spaced framing ribs 75, and the lower support member 82 may also be permanently secured not only to the framing ribs 75 but also to the wall 78 of the bucket 15. The lower support member 82 presents an outwardly directed bearing surface 83 which will lie in contiguous juxtaposition with bearing surface 61 on the lower transverse beam member 31 of the master coupling element 11 (or the bearing surface 161 on the lower transverse beam member 131 of the coupling element 111) when the coupling receiver 12 is operatively mounted on the master coupling element 11 (or the master coupling element 111).

The lower support member 82 also presents an outwardly extending latch plate 84. A pair of locking apertures 85 are presented from the latch plate 84, and the locking apertures 85A and 85B receive the respective locking pins 69A and 69B when the implement coupling element 12 is secured to either master coupling element 11 or 111. As such, the lower support member 82 may also comprise a structural angle the two legs of which present the aforesaid bearing surface 83 and the latch plate 84 which are angularly disposed, one with respect to the other.

For added strength a stringer 88 in the shape of a third angle iron may also extend between the uppermost extremities of the framing ribs 75A and 75B. The stringer 88 may be permanently secured not only to the ribs 75A and 75B but also to the curvilinear rear wall 78 of the bucket 15.

The implement coupling element 12 is depicted as being permanently secured to the bucket 15. The rearwardly directed surface of the bucket 15 is curvilinear, and to accommodate that special configuration the implement coupling element 12 is itself uniquely configured. However, a variation of the implement coupling element 112 is adapted to be secured to a work implement presenting a planar, rather than a curvilinear, rearwardly directed surface. An example of such an implement coupling element 112 is depicted in FIG. 8 and is shown as supporting the tines of a fork lift arrangement.

The implement coupling element 112 has a pair of laterally spaced, framing ribs 175A and 175B. An upper support member 179 extends transversely between the laterally spaced framing ribs 175, and it is permanently secured to the laterally spaced framing ribs 175. The upper support member 179 presents an upwardly directed mounting surface 180 to which the receiver 129 may be affixed and an outwardly (i.e., rearwardly) directed bearing surface 181 which will lie in contiguous juxtaposition with bearing surface 60 on the upper transverse member 26 of the master coupling element 11 (or the bearing surface 160 on the upper transverse member 126 of the master coupling element 111) when the coupling receiver 12 is operatively mounted on the master coupling element 11 (or the master coupling element 111). For maximum structural integrity the upper support member 179 may comprise a box beam structural arrangement with two surfaces thereof presenting the aforesaid mounting surface 180 and the bearing surface 181.

A lower support member 182 is spaced beneath the upper support member 179 to extend transversely between the laterally spaced framing ribs 175, and the lower support member 182 may also be permanently secured to the framing ribs 175. The lower support member 182 presents an outwardly directed bearing surface 183 which will lie in contiguous juxtaposition with bearing surface 61 on the lower transverse beam member 31 of the master coupling element 11 (or the bearing surface 161 on the lower transverse beam member 131 of the master coupling element 111) when the coupling receiver 112 is operatively mounted on the master coupling element 11 (or the master coupling element 111).

The lower support member 182 also presents an outwardly extending latch plate 184. A pair of locking apertures 185 are presented from the latch plate 184, and the locking apertures 185A and 185B receive the respective locking pins 169A and 169B when the implement coupling element 112 is secured to either master coupling element 11 or 111. As such, the lower support member 182 may well comprise a structural angle the two legs of which present the aforesaid bearing surface 183 and the latch plate 184 which are angularly disposed, one with respect to the other.

If desired, or required, a stiffener plate 187 may also extend transversely between the laterally spaced framing ribs 175, and the stiffener plate 187 may also be permanently secured to the framing ribs 175. Added support can be achieved by permanently securing the stiffener plate 187 to the lower support member 182, as well.

The fork lifting tines 117 may be supported from a shaft 189 which extends transversely between the laterally spaced framing ribs 175, and for additional support to the shaft 189, a vertically disposed stanchion 190 extends between the upper and lower support members 179 and 182, respectively. As depicted, a collar 191 is presented from each tine 117 swingably to engage the shaft 189. If desired, a pair retainer arms 192 may be secured to, and extend vertically upwardly from, the upper support member 179.

In both the implement coupling element 12 and the implement coupling element 112 the receiver 29 (or 129) and the latch plate 84 (or 184) are vertically separated to the maximum possible extent. The bearing surface 81 (or 181) is similarly separated vertically from bearing surface 83 (or 183) to the maximum possible extent. Thus, when the aligning horn 28 (or 128) is insertably received within the receiver 29 (or 129)—each of which has an internal configuration that is substantially identical to the external configuration of the aligning horn 28 (or 128)—the locking mechanism 30 (or 130) serves merely to maintain the bearing surfaces 60 and 61 (or 160 and 161) on the master coupling element 11 (or 111) in contiguous juxtaposition with the bearing surfaces 81 and 83 (or 181 and 183), respectively, on the implement coupling element 12 (or 112).

As such, the dynamic stresses associated with the loading and lifting the work implement and the static stresses associated with maintaining the loaded work implement in an elevated position are transferred between the master coupling element 11 (or 111) and the implement coupling element 12 (or 112) by virtue of the engaged bearing surfaces 60, 61, 81 and 83 (or 160, 161, 181 and 183) and not the locking mechanism 30 (or 130) and the associated latch plate 84 (or 184). In addition, the vertically spaced disposition of the horizontally oriented bearing surfaces allows the coupling elements 11 and 12 (111 and 112) to be joined with the center of gravity for the load on the work implement to be located as rearwardly as possible.

In those situations in which the work implement is utilized in such a way that the implement coupling element 12 tends to separate from the master coupling element 11, as exemplified when dumping or back-dragging, maximizing the vertical dimension between the aligning horn 28 and the locking pins 69 also maximizes the moment arm effective therebetween. This is quite important when the work implement is utilized in a way which tends to force the implement coupling element away from the master coupling element 11. When dumping or back-dragging the implement coupling element 12 tends to rotate about the fulcrum provided by engagement of the aligning horn 28 with the horn receiver 29, but separation of the implement coupling element 12 from the master coupling element 1 is prevented by engagement of the locking pins 69 with the locking apertures 85. Hence, by maximizing the moment arm between the aligning horn 28 and the locking pins 69, the shear stress imposed upon the locking pins 69 to secure the implement coupling element 12 to the master coupling element 11 is minimized.

As should, therefore, now be apparent, the present invention not only provides a unique coupling assembly but also accomplishes the other objects of the invention.

We claim:

1. A coupling assembly for demountably attaching a work implement to a prime mover having lifting and tilting mechanisms, said coupling assembly comprising:

a master coupling element adapted to be mounted on the lifting and tilting mechanisms of the prime mover;

an implement coupling element adapted to be attached to a work implement;

said master coupling element having a substantially rectangular frame with upper and lower beam members extending transversely between laterally spaced side plates;

an aligning horn extending upwardly from said upper transverse beam member;

a first, forwardly directed bearing surface extending between said side plates along substantially the entire lateral extent of said upper transverse beam member;

a second, forwardly directed bearing surface extending between said side plates along substantially the entire lateral extent of said lower tranverse beam member;

said implement coupling element having upper and lower, transversely oriented support members;

a receiver presented from said upper support member to be operatively engaged by said aligning horn;

a first, rearwardly directed bearing surface extending fully along said upper support member for a lateral extent substantially equal to the lateral extent of said first bearing surface on said upper transverse beam member of said master coupling element;

a second, rearwardly directed bearing surface extending fully along said lower support member for a lateral extent substantially equal to the lateral extent of said second bearing surface on said lower transverse beam member of said master coupling element;

a locking mechanism releasably to secure said implement coupling element to said master coupling element; and, said first and second bearing surfaces on said master coupling element being engaged along substantially the full lateral extent thereof by said first and second bearing surfaces, respectively, on said implement coupling element when said aligning horn is operatively engaged within said receiver and said locking mechanism is securing said implement coupling element to said master coupling element.

2. A coupling assembly for demountably attaching a work implement to a prime mover having lifting and tilting mechanisms, said coupling assembly comprising:

a master coupling element adapted to be mounted on the lifting and tilting mechanisms of the prime mover;

an implement coupling element adapted to be attached to a work implement;

said master coupling element having a frame with upper and lower transverse beam members;

an aligning horn extending upwardly from said upper transverse beam member;

a first, forwardly directed bearing surface extending along said upper transverse beam member;

a second, forwardly directed bearing surface extending along said lower transverse beam member;

said implement coupling element having upper and lower, transversely oriented support members;

a receiver presented from said upper support member to be operatively engaged by said aligning horn;

a first, rearwardly directed bearing surface extending along said upper support member;

a second, rearwardly directed bearing surface extending along said lower support member;

a locking mechanism releasably to secure said implement coupling element to said master coupling element;

said locking mechanism comprising:

locking apertures presented from said implement coupling element;

locking pins mounted on said master coupling element for protraction and retraction into and out of engagement with said locking apertures;

said locking apertures being located in vertically spaced relation beneath said receiver; and, said first and second bearing surfaces on said master coupling element being engaged by said first and second bearing surfaces, respectively, on said implement coupling element when said aligning horn is operatively engaged within said receiver and said locking mechanism is securing said implement coupling element to said master coupling element.

3. A coupling assembly for demountably attaching a work implement to a prime mover, as set forth in claim 2, wherein:

said locking apertures are located beneath the level of said bearing surface on said lower support member.

4. A coupling assembly for demountably attaching a work implement to a prime mover, as set forth in claim 1, wherein:

a clevis plate is secured to said frame laterally outwardly from each said side plate; and means are provided to secure the lifting mechanism of the prime mover between said side plates and said laterally spaced clevis plates.

5. A coupling assembly for demountably attaching a work implement to a prime mover, as set forth in claim 4, wherein:

means are provided to secure the tilting mechanism of the prime mover between said side plates and said laterally spaced clevis plates.

6. A coupling assembly for demountably attaching a work implement to a prime mover, as set forth in claim 4, wherein:

a pair of laterally spaced, connector plates extend substantially vertically between the medial portions of said upper and lower, transverse beam members; and, means are provided to secure the tilting mechanism of the prime mover between said connector plates.

7. A master coupling element adapted to be mounted on the lifting and tilting mechanisms of a prime mover for demountably attaching a work implement to the lifting and tilting mechanisms, said master coupling element comprising:

a frame with upper and lower transverse beam members;

an aligning horn extending upwardly from said upper transverse beam member;

a first, forwardly directed bearing surface extending along substantially the entire lateral extent of said upper transverse beam member;

a second, forwardly directed bearing surface extending along substantially the entire lateral extent of said lower transverse beam member; and, a locking mechanism presented from said lower transverse beam member.

8. A master coupling element, as set forth in claim 7, wherein:

said upper and lower transverse beam members are secured to side plates;

said upper and lower beam members and said side plates define a frame of generally rectilinear configuration; and, an open central portion is defined by said upper and lower transverse beam members and said side plates to permit visual observation therethrough.

9. A master coupling element, as set forth in claim 7, wherein:

said upper and lower transverse beam members are secured to side plates to define a frame;

a clevis plate is secured to said frame laterally outwardly from each said side plate; and, means are provided to secure the lifting mechanism of a prime mover between said side plates and the laterally spaced clevis plates.

10. A master coupling element, as set forth in claim 9, wherein:

means are provided to secure the tilting mechanism of the prime mover between said side plates and said laterally spaced clevis plates.

11. A master coupling element, as set forth in claim 9, wherein:

a pair of laterally spaced, connector plates extend substantially vertically between the medial portions of said upper and lower, transverse beam members; and, means are provided to secure the tilting mechanism of the prime mover between said connector plates.

12. An implement coupling element adapted to be secured to a work implement and also adapted to be demountably attached to a master coupling element presented from the lifting and tilting mechanisms of a prime mover, said implement coupling element comprising:

upper and lower, transversely oriented support members;

a receiver presented from said upper support member to be operatively engaged by an aligning horn on the master coupling element;

a first, rearwardly directed bearing surface extending substantially along the lateral length of said upper support member;

a second, rearwardly directed bearing surface extending substantially along the lateral length of said lower support member; and, a locking mechanism presented from said lower support member.

13. An implement coupling element, as set forth in claim 12, wherein:

locking apertures are presented from said implement coupling element;

said locking apertures being located in vertically spaced relation beneath said receiver.

14. An implement coupling element, as set forth in claim 13, wherein:

said locking apertures are located beneath the level of said bearing surface on said lower support member.

* * * * *